US006511947B1

(12) United States Patent
Nakanishi et al.

(10) Patent No.: US 6,511,947 B1
(45) Date of Patent: Jan. 28, 2003

(54) HEAT RESISTING LUBRICATING OIL COMPOSITION

(75) Inventors: Hiroshi Nakanishi, Saitama (JP); Noboru Umemoto, Saitama (JP)

(73) Assignee: Tonen General Sekiyu K.K., Saitama (JP)

( * ) Notice: Subject to any disclaimer, the term of this patent is extended or adjusted under 35 U.S.C. 154(b) by 0 days.

(21) Appl. No.: 09/887,627

(22) Filed: Jun. 22, 2001

(51) Int. Cl.[7] ..... C10M 169/04
(52) U.S. Cl. ..... 508/436
(58) Field of Search ..... 508/436, 437

(56) References Cited

U.S. PATENT DOCUMENTS

| | | | | | |
|---|---|---|---|---|---|
| 3,321,403 | A | * | 5/1967 | Campbell et al. | 508/436 |
| 3,748,269 | A | * | 7/1973 | Clark | 508/436 |
| 3,844,961 | A | * | 10/1974 | Clark | 508/436 |
| 3,994,815 | A | * | 11/1976 | Coleman | 508/437 |
| 6,191,080 | B1 | * | 2/2001 | Nakanishi et al. | 508/437 |

FOREIGN PATENT DOCUMENTS

| | | | |
|---|---|---|---|
| JP | 409151388 | * | 6/1997 |

* cited by examiner

*Primary Examiner*—Jacqueline V. Howard
(74) *Attorney, Agent, or Firm*—Linda M. Scuorzo

(57) ABSTRACT

Heat resistant lubricatant oil compositions consisting of a synthetic lubricating oil composition mainly composed of a polyphenyl ether and so excellent in heat and oxidation resistance and wear resistance as to be suitable for use under severe conditions, particularly, under high-temperature and high-load conditions are disclosed. One embodiment is a lubricating oil composition obtained by mixing, to (a) a base oil consisting of a polyphenyl ether and/or a polyphenyl thioether, (b) an amine-type antioxidant 0.1–0.8 mass %, on the basis of the total mass of the lubricating oil composition, (c) a phosphate 2–3 mass %, and (d) an amine salt of acid phosphate 0.07–0.15 mass %. A second embodiment is a lubricating oil composition obtained by mixing, to (a) a base oil consisting of a polyphenyl ether having 5 aromatic rings and/or its hydrocarbon substituted group, (b) a polyphenyl thioether 0.05–5 mass %, on the basis of the total mass of the lubricating oil composition, (c) an amine antioxidant 0.05–5 mass %, (d) a phosphate 2–3 mass %, and (e) an amine salt of acid phosphate 0.07–0.3 mass %.

6 Claims, No Drawings

HEAT RESISTING LUBRICATING OIL COMPOSITION

FIELD OF THE INVENTION

This invention relates to a heat resistant lubricating oil composition having both enhanced heat and oxidation resistance and wear resistance and, which is suitable for the use under high-temperature and high-load lubricating conditions.

BACKGROUND OF THE INVENTION

In recent years, lubricating oils of high quality resistible to severe use conditions are required in accordance with the higher performance and higher efficiency of mechanical devices and power devices. For jet engines, gas turbines, and turbo engines, for example, lubricating oils particularly enhanced heat resistance and oxidation resistance are necessary because of their operations at high temperature.

Accordingly, esters of hindered alcohol with fatty acid such as pentaerythritol or trimethylol propane have been developed as the base oil for jet engine oil so far. In order to satisfy the requirement of USAF Standard MIL-PRF-87100A as jet engine lubricating oil, further, a polyphenyl ether (5P4E) comprising 4–5 aromatic rings connected through oxygen atoms is proposed as a heat resisting lubricating oil having higher heat and oxidation resistances.

However, such a polycyclic polyphenyl ether has deficiencies of high pour point, low viscosity index, and particularly in wear resistance in spite of excellent heat and oxidation resistances.

Therefore, attempts have been made to develop a lubricating oil that also has enhanced wear resistance as well and further is improved in pour point and viscosity index by mixing a polyphenyl thioether with the polyphenyl ether and by adding a phosphorus-type anti-wear agent to address the deficiency in wear resistance. However, the addition of the phosphorus-type anti-wear agent causes the problem of deterioration of heat and oxidation resistances. Applicants' invention addresses the need for compositions having all these characteristics.

SUMMARY OF THE INVENTION

An embodiment of the invention is a heat resisting synthetic lubricating oil composition having enhanced heat and oxidation resistance and wear resistance for use under severe conditions, particularly, high-temperature conditions, which were attainable by the conventional lubricating oils.

The inventors found that a lubricating oil composition consisting of a polyphenyl ether having 4–5 aromatic rings, a polyphenyl thioether having 3–5 aromatic rings, an amine-type antioxidant, a phosphate, and an amine salt of acid phosphate can restrain the inhibiting effect on the heat and oxidation resistance by the phosphorus-type anti-wear agent and exhibit enhanced heat and oxidation resistance and wear resistance which could not be attained by the polyphenyl ether, the polyphenyl thioether, the amine-type antioxidant or the phosphorus-type anti-wear agent alone.

Accordingly, an embodiment of the invention is a lubricating oil composition obtained by mixing, to (a) a base oil consisting of component (i) or (ii):

(i) a mixture of a polyphenyl ether having 4–5 aromatic rings and/or its hydrocarbon substituted group with a polyphenyl thioether having 3–5 aromatic rings represented by the following general formula [I]

(ii) a polyphenyl thioether having 3–5 aromatic rings represented by the following general formula [I]

[I]

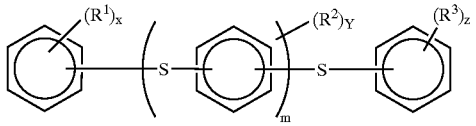

wherein $R^1$, $R^2$ and $R^3$, which may be the same or different, each represents hydrogen atom or a hydrocarbon group having 1–24 carbon atoms, x, y and z, which may be the same or different, each represents an integer of 1–4, and m represents an integer of 1–3;

(b) an amine-type antioxidant: 0.1–0.8 mass %, on the basis of the total mass of the lubricating oil composition;

(c) a phosphate: 2–3 mass %; and (d) an amine salt of acid phosphate: 0.07–0.15 mass %.

This invention further involves a second lubricating oil composition obtained by mixing, to (a) a base oil consisting of a polyphenyl ether having 5 aromatic rings and/or its hydrocarbon substituted group;

(b) a polyphenyl thioether represented by the following general formula [I]: 0.05–5 mass %, on the basis of the total mass of the lubricating oil composition;

[I]

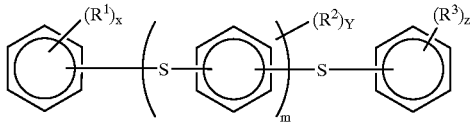

wherein $R^1$, $R^2$ and $R^3$, which may be the same or different, each represents hydrogen atom or a hydrocarbon group having 1–24 carbon atoms, x, y and z, which may be the same or different, each represents an integer of 1–4, and m represents an integer of 1–3, (c) an amine-type antioxidant: 0.05–5 mass %;

(d) a phosphate: 2–3 mass %; and (e) an amine salt of acid phosphate: 0.07–0.3 mass %.

According to this invention, the following 1 and 2 can be given as preferred embodiments.

(1) A heat resisting lubricating oil composition obtained by mixing to a base oil consisting of:

(a) at least one polyphenyl ether selected from the group consisting of bis(m-phenoxyphenyl)ether (mm-4P3E), m-phenoxyphenoxy m-biphenyl (mm-4P2E), m-bis(m-phenoxyphenoxy)benzene (mmm-5P4E) and 5P4E isomeric mixture (a mixture of mmm-5P4E, mmp-5P4E, pmp-5P4E); and (b) a polyphenyl thioether represented by the general formula [I]:

[I]

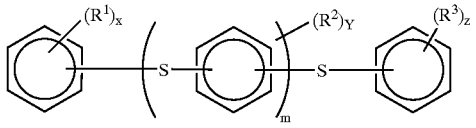

wherein $R^1$, $R^2$ and $R^3$, which may be the same or different, each represents hydrogen atom or a hydrocarbon group having 1–24 carbon atoms, x, y and z, which may be the same or different, each represents an integer of 1–4, and m represents an integer of 1–3, (a) alkyl naphthylamine: 0.1–0.7 mass %;

(b) tricresyl phosphate: 2–3 mass %; and (c) aromatic amine salt of acidic phosphate: 0.07–0.15 mass %.

(2) A heat resisting lubricating oil composition obtained by mixing to (a) a base oil consisting of a mixture of m-bis(m-phenoxyphenoxy) benzene (mmm-5P4E), 1-(m-phenoxyphenoxy)-3-(p-phenoxyphenoxy)benzene (mmp-5P4E) and m-bis(p-phenoxyphenoxy) benzene (pmp-5P4E);

(b) at least one polyphenyl thioether selected from the group consisting of m-bis(phenylmercapto)benzene (m-3P2T), bis(phenylmercapto) benzene isomer mixture (mix-3P2T), bis(m-phenylmercaptophenyl) sulfide (mm-4P3T), bis(phenylmercaptophenyl) sulfide isomeric mixture, m-bis (m-phenylmercaptophenylmercapto)benzene (mmm-5P4T): 0.05–5 mass %;

(c) phenyl-α-naphthylamine and di(alkylphenyl)amine: 0.05–5 mass %;

(d) tricresyl phosphate: 2–3 mass %; and (e) aromatic amine salt of acidic phosphate: 0.07–0.3 mass %.

Another embodiment of the invention includes the method for enhancing the heat and oxidation wear resistance of an engine by adding to the engine a lubricating oil of the compositions specified above.

DETAILED DESCRIPTION OF THE PREFERRED EMBODIMENTS

This invention is further described in detail below.

Polyphenyl Ether

The polyphenyl ether used as the component of the heat resisting lubricating oil composition according to this invention comprises aromatic rings bonded through oxygen atom, and it preferably has 4–5 aromatic rings in the molecule.

In the polyphenyl ether used in the lubricating oil composition according to this invention, the ether bond may be located in any position, but preferably in meta-position from the viewpoint of ensuring a low pour point.

Concrete examples of the polyphenyl ether used in the lubricating oil composition according to this invention include bis(m-phenoxyphenyl)ether (mm-4P3E), m-phenoxyphenyl p-phenoxyphenyl ether (mp-4P3E), m-phenoxyphenyl o-phenoxyphenyl ether (mo-4P3E), bis (p-phenoxyphenyl)ether (pp-4P3E), p-phenoxyphenyl o-phenoxyphenyl ether (po-4P3E), bis(o-phenoxyphenyl) ether (oo-4P3E), bis(phenoxyphenyl)ether isomer mixture (mix-4P3E), m-phenoxyphenoxy m-biphenyl (mm-4P2E), m-bis(m-phenoxyphenoxy)benzene (mmm-5P4E), 1-(m-phenoxyphenoxy)-3-(p-phenoxyphenoxy)benzene (mmp-5P4E), p-bis(m-phenoxyphenoxy)benzene (mpm-5P4E), 1-(m-phenoxyphenoxy)-4-(p-phenoxyphenoxy)benzene (pmp-5P4E), p-bis(p-phenoxyphenoxy)benzene (ppp-5P4E), o-bis(m-phenoxyphenoxy)benzene (mom-5P4E), m-bis(o-phenoxyphenoxy)benzene (omo-5P4E), p-bis(o-phenoxyphenoxy)benzene (opo-5P4E), o-bis(o-phenoxyphenoxy)benzene (ooo-5P4E), and bis (phenoxyphenoxy)benzene isomer mixture (mix-5P4E), and these can be used in combination of two ore more so as to provide a liquefied one in ordinary state.

The hydrocarbon substituted group of such a polyphenyl ether can be also used. As the hydrocarbon group, a linear or branched alkyl group is preferable. As the alkyl group, those having 1–24 carbon atoms, particularly, 5–20 carbon atoms are used.

As the hydrocarbon substituted group of the polyphenyl ether, a one having 1–4 alkyl groups bonded per molecule of the polyphenyl ether is used. Concrete examples thereof include monoalkyl bis(m-phenoxyphenyl)ether (R-mm-4P3E), monoalkyl m-phenoxyphenoxy m-biphenyl (R-mm-4P2E), monoalkyl m-phenoxyphenoxy o-biphenyl (R-mo-4P2E) and dialkyl m-phenoxyphenoxy o-biphenyl ($R_2$-mo-4P2E).

Polyphenyl Thioether

The polyphenyl thioether used in the heat resisting lubricating oil component according to this invention comprises aromatic rings bonded through sulfur atoms, and it is represented by the following general formula [I]:

[I]

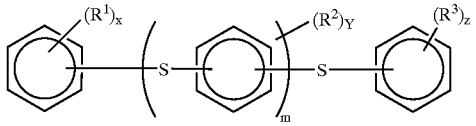

In the above general formula [I], $R^1$, $R^2$, and $R^3$, which may be the same or different, each represents hydrogen atom or a hydrocarbon group having 1–24 carbons atoms. The compound wherein all $R^1$, $R^2$, and $R^3$ are hydrogen atoms is a hydrocarbon non-substituted polyphenyl thioether. Examples of the hydrocarbon group include a linear or branched alkyl group having 1–24 carbon atoms; a linear or branched alkenyl group having 2–24 carbon atoms; a cycloalkyl group having 6–24 carbon atoms; an aryl group having 6–24 carbon atoms, and the like. The aryl group may have an alkyl group having 1–12 carbon atoms or an alkenyl group having 2–12 carbon atoms as a substituent. A preferable hydrocarbon group is an alkyl group having 6–20 carbon atoms, and concretely, hexyl, heptyl, octyl, nonyl, decyl, undecyl, dodecyl, tridecyl, tetradecyl, pentadecyl, hexadecyl, heptadecyl, octadecyl, nonadecyl, and eicocyl group and those having branches thereof are used. Particularly, a one having 8–18 carbon atoms is preferably used. The hydrocarbon group may be bonded to any position of the polyphenyl thioether aromatic ring.

In the above general formula [I], x, y and z, which may be the same or different, each represents an integer of 1–4, and m represents an integer of 1–3. The polyphenyl thioether include compounds having 3–5 aromatic rings. The thioether of the polyphenyl thioether may be located in any position of the aromatic ring, but preferably in meta-position from the viewpoint of retaining the fluidity property.

As the polyphenyl thioether represented by the general formula [I], a hydrocarbon non-substituted polyphenyl thioether and a hydrocarbon-substituted polyphenyl thioether can be used. The hydrocarbon non-substituted polyphenyl thioether is represented by the following general formula [II]:

[II]

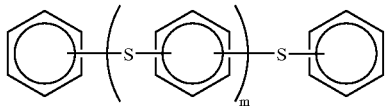

wherein m represents an integer of 1–3.

This compound is a particularly preferable compound for this invention from the viewpoint of the improvement in physical properties of the lubricating oil composition, for example, viscosity and viscosity index, in addition to the improvement in heat and oxidation resistances and wear resistance.

Concrete Examples of the hydrocarbon non-substituted polyphenyl thioether include m-bis(phenylmercapto) benzene (m-3P2T), o-bis(phenylmercapto) benzene (o-3P2T), p-bis(phenylmercapto)benzene (p-3P2T), bis (phenylmercapto) benzene isomeric mixture (mix-3P2T), bis(m-phenylmercaptophenyl)sulfide (mm-4P3T), bis(o-phenylmercaptophenyl)sulfide (oo-4P3T), bis (p-phenylmercaptophenyl)sulfide (pp-4P3T), m-phenylmercaptophenyl p-phenylmercaptophenyl sulfide (mp-4P3T), m-phenylmercatophenyl o-phenylmercaptophenyl sulfide (mo-4P3T), p-phenylmercaptophenyl o-phenylmercaptophenyl sulfide (po-4P3T), bis(phenylmercaptophenyl) sulfide isomeric mixture (mix-4P3T), m-bis m-(phenylmercaptophenylmercapto) benzene (mmm-5P4T), 1-(m-phenylmercaptophenylmercapto)-3-(p-phenylmercaptophenylmercapto)benzene (mmp-5P4T), p-bis-(m-phenylmercaptophenylmercapto)benzene (mpm-5P4T), 1-(m-phenylmercaptophenylmercapto)-4-(p-phenylmercaptophenylmercapto) benzene (mpp-5P4T), m-bis(p-phenylmercaptophenylmercapto)benzene (pmp-5T4T), p-bis(p-phenylmercaptophenylmercapto)benzene (ppp-5P4T), o-bis (m-phenylmercaptophenylmercapto) benzene (mom-5P4T), m-bis (o-phenylmercaptophenylmercapto)benzene (omo-5P4T), p-bis (o-phenylmercaptophenylmercatpo)benzene (opo-5P4T), o-bis (o-phenylmercaptophenylmercapto)benzene (ooo-5P4T), bis(phenylmercaptophenylmercapto)benzene isomeric mixture (mix-5P4T), and the like.

Concrete examples of the hydrocarbon-substituted polyphenyl thioether include a mono-, di- or tri-alkyl polyphenyl thioether obtained by bonding 1–3 alkyl groups having 6–20 carbon atoms as described above within the molecule. For example, alkylated products such as bis(m-phenylmercaptophenyl)sulfide (mm-4P3T), m-bis(m-phenylmercaptophenylmercapto)benzene (mmm-5P4T) can be given in addition to monoalkyl m-bis(phenylmercapto) benzene (R-m-3P2T), dialkyl m-bis(phenylmercapto) benzene ($R_2$-m-3P2T), and trialkyl m-bis(phenylmercapto) benzene ($R_3$-m-3P2T).

Among the compounds described above, the hydrocarbon non-substituted polyphenyl thioether is suitable for the lubricating oil composition of this invention. Examples thereof include m-bis(phenylmercapto)benzene (m-3P2T), o-bis (phenylmercapto)benzene (o-3P2T), p-bis(phenylmercapto) benzene (p-3P2T) and bis(m-phenylmercaptophenyl)sulfide (mm-4P3T), and m-bis(m-phenylmercaptophenylmercapto) benzene (mmm-5P4T) is also particularly useful from the viewpoint of the improvement in heat and oxidation resistance and the regulation of physical properties of the lubricating oil composition.

The compounds preferable as the above hydrocarbon non-substituted polyphenyl thioether can be represented by the following chemical formulae. Namely, m-bis (phenylmercapto)benzene (m-3P2T) is represented by the chemical formula (1):

(1)

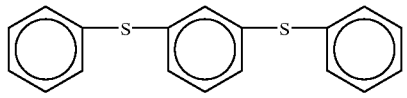

bis(m-phenylmercaptophenyl)sulfide (mm-4P3T) is represented by the chemical formula (2):

(2)

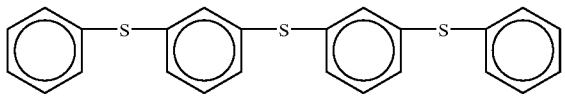

m-bis(m-phenylmercaptophenylmercapto)benzene (mmm-5P4T) is represented by the chemical formula (3):

(3)

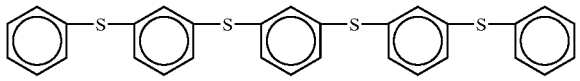

and, o-bis(phenylmercapto)benzene (p-3P2T) is represented by the chemical formula (4):

(4)

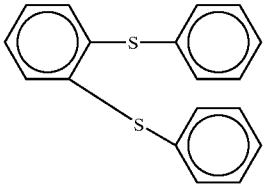

Amine-Type Antioxidant

As the amine-type antioxidant, a diarylamine is used. As the diarylamine, a compound represented by the following general formula [III] or general formula [IV] is used.

[III]

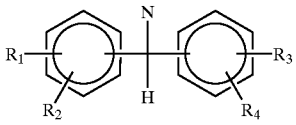

[IV]

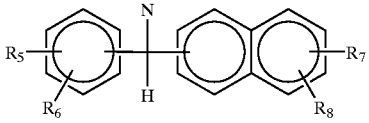

In the above general formulae [III] and [IV], $R_1$–$R_8$, which may be the same or different, each represents hydrogen atom or a hydrocarbon group having 1–18 carbon atoms. Examples of the hydrocarbon group include a linear or branched alkyl group having 1–18 carbon atoms; a linear or branched alkenyl group having 2–18 carbon atoms; a cycloalkyl group having 6–18 carbon atoms; an aryl group having 6–18 carbon atoms; and the like, and the aryl group may contain an alkyl group or alkenyl group having 1–12 carbon atoms. More concrete examples thereof include diphenylamine, pp'-dibutyl diphenylamine, pp'-dipentyl diphenylamine, pp'-dihexyl diphenylamine, pp'-diheptyl diphenylamine, pp'-dioctyl diphenylamine, pp'-dinonyl diphenylamine, monooctyl diphenylamine, monononyl diphenylamine, tetrabutyl diphenylamine, tetrahexyl diphenylamine, tetraoctyl diphenylamine, tetranonyl diphenylamine, mixed alkyl diphenylamine having 4–9 carbon atoms, phenyl-α-naphthylamine, phenyl-β-naphthylamine, butylphenyl-α-naphthylamine, butylphenyl-β-naphthylamine, pentylphenyl-α-naphthylamine, pentylphenyl-β-naphthylamine, hexylphenyl-α-naphthylamine, hexylphenyl-β-naphthylamine, heptylphenyl-α-naphthylamine, heptylphenyl-β-naphthylamine, octylphenyl-α-naphthylamine, octylphenyl-β-naphthylamine, nonylphenyl-α-naphthylamine, nonylphenyl-β-naphthylamine, and the like.

As a referable example of the diarylamine represented by the general formula [III], pp'-diocyl diphenylamine can be given. As a preferable example of the diarylamine represented by the general formula [IV], phenyl-α-naphtylamine and alkylphenyl-α-naphtylamine can be given. Further, phenotiazine, N-methylphenotiazine, and N-ethylephenotiazine are also usable.

Phosphate

The phosphate used in the heat resisting lubricating oil composition according to this invention is represented by the following general formula [V].

[V]

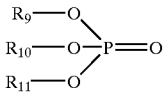

In the general formula [V], $R_9$–$R_{11}$, which may be the same or different, each represents a hydrocarbon group having 1–18 carbon atoms, including, for example, a linear or branched alkyl group having 1–13 carbon atoms; a linear or branched alkenyl group having 2–13 carbon atoms; a cycloalkyl group having 6–18 carbon atoms; and an aryl group having 6–18 carbon atoms. The aryl group may have an alkyl group having 1–12 carbon atoms. A particularly preferred hydrocarbon group is the alkyl or aryl group. As the alkyl group, those having 4–10 carbon atoms are preferable, including butyl, pentyl, hexyl, heptyl, octyl and the like. Examples of the aryl group include phenyl, tolyl, xylyl, naphthyl, and the like. Concrete examples of the phosphate having the aryl group include triphenyl phosphate, tricresyl phosphate, benzyldiphenyl phosphate, ethyldiphenyl phosphate, cresylphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenylphenyl phosphate, tripropylphenyl phosphate, butylphenyldiphenyl phosphate, dibutylphenylphenyl phosphate, dibutylphenyl phosphate, propylphenylphenyl phosphate and the like. The compounds may be used alone or in combination of two or more, and tricresyl phosphate is particularly preferred.

Amine Salt of Acid Phosphate

The amine salt of acid phosphate as the essential component of the additive of the lubricating oil composition according to this invention is a reaction product of acidic phosphate components represented by the general formulae [VI] and [VII] with an amine compound.

[VI]

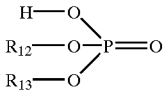

[VII]

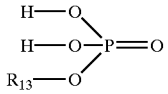

As the acidic phosphate component, the compound of the general formula [VI] and the compound of the general formula [VII] can be used alone, but the mixture thereof is generally used.

In the above general formulae [VI] and [VII], $R_{12}$ and $R_{13}$, which may be the same or different, each represents a hydrocarbon group having 1–20 carbon atoms. Examples of the hydrocarbon group include a linear or branched alkyl group having 1–20 carbon atoms; a linear or branched alkenyl group having 2–20 carbon atoms; an aryl group having 6–20 carbon atoms, an alkylaryl group or arylalkyl group having a linear or branched alkyl group. A compound having a linear or branched alkyl group or alkenyl group having 3–18 carbon atoms is particularly preferred. More concretely, examples of $R_{12}$ and $R_{13}$ include an alkyl group such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicocyl or the like; an alkenyl group such as propenyl, butenyl, pentenyl, hexenyl, heptenyl, octenyl, nonenyl, decenyl, undecenyl, dodecenyl, tetradecenyl, pentadecenyl, hexadecenyl, heptadecenyl, octadecenyl, nodadecenyl, eicocenyl or the like; an aryl group such as phenyl, naphthyl or the like; an alkylaryl group such as tolyl, ethylphenyl, propylphenyl, butylphenyl, pentylphenyl, hexylphenyl, heptylphenyl, octylphenyl or the like; and an arylalkyl group such as benzyl, phenylethyl, phenylpropyl, phenylbutyl or the like. These hydrocarbon groups include isomers such as iso-bodies, respectively.

Concrete examples of a preferred compound of the acidic phosphate include diisopropyl acid phosphate, dibutyl acid phosphate, dihexyl acid phosphate, di(2-ethylhexyl) acid phosphate, didecyl acid phosphate, didodecyl acid phosphate, dioctadecyl acid phosphate(distearyl acid phosphate), di-9-octadecenyl acid phosphate (dioleyl acid phosphate) and mixtures thereof.

As an example of the amine compound to be reacted with the acid phosphate component, a primary or secondary amine having a hydrocarbon group having 4–20 carbon atoms can be given. As the hydrocarbon group, for example, a linear or branched alkyl group having 4–20 carbon atoms; a linear or branched alkenyl group having 4–20 carbon atoms; an aryl group having 6–20 carbon atoms; an alkyl aryl group having a linear or branched alkyl group, and an arylalkyl group can be given. Concrete examples thereof include an alkyl group such as butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicocyl or the like; an alkenyl group such as butenyl, pentenyl, hexenyl, heptenyl, octenyl, nonenyl, decenyl, undecenyl, dodecenyl, tetradecenyl, pentadecenyl, hexadecenyl, heptadecenyl, octadecenyl, nonadecenyl, eicocenyl or the like; an aryl group such as phenyl, naphthyl or the like; an alkylaryl group such as tolyl, ethylphenyl, propylphenyl, butylphenyl, pentylphenyl, hexylphenyl, heptylphenyl, octylphenyl, nonylphenyl, decylphenyl, dodecylphenyl, tridecylphenyl, tetradecylphenyl, pentadecylphenyl, hexadecylphenyl, heptadecylphenyl, octadecylphenyl, nonadecylphenyl or the like; and an arylalkyl group such as benzyl, phenylethyl, phenylpropyl, phenylbutyl or the like. These hydrocarbon groups include isomers, respectively.

As a preferred acidic phosphate, for example, a reaction product of methyl acid phosphate with a trialkylamine having 10–14 carbon atoms, a reaction product of isopropyl acid phosphate with dodecylphenylamine, a reaction product of diisopropyl acid phosphate with dodecylaniline, a reaction product of butyl acid phosphate with dodecylphenylamine, a reaction product of butyl acid phosphate with alkyl aromatic amine, a reaction product of hexyl acid phosphate with ditridecylamine, a reaction product of octyl acid phosphate with oleylamine, and a reaction product of i-$C_8$–$C_{10}$ alkyl acid phosphate with oleylamine can be given. Particularly, isooctyl acid phosphate amine [the reaction product of $(i\text{-}C_8H_{17}O)_2P(OH)O$ with $C_{16}H_{33}NH_2$], 2-ethylhexyl acid phosphate amine salt [the reaction product of $(C_8H_{17}O)_2P(O)OH+C_8H_{17}OP(O)(OH)_2$ with isotridecylamine], and di-9-octadecenyl acid phosphate amine salt (dioleyl acid phosphate amine salt) are preferably used.

In addition to the above-mentioned acid phosphate amine salts, an acidic phosphite amine salt can be also used in combination therewith. As the acidic phosphite used for the preparation of the amine salt, for example, di-2-ethylhexyl hydrogen phosphite, didecyl hydrogen phosphite or the like can be given.

Lubricating Oil Composition (I)

A heat resisting lubricating oil composition (I) according to this invention is obtained by mixing, to (a) a base oil consisting of (i) a mixture of a polyphenyl ether having 4–5 aromatic rings with a polyphenyl thioether having 3–5 aromatic rings represented by the general formula [I] or (ii) at least two polyphenyl thioethers having 3–5 aromatic rings represented by the general formula [I], on the basis of the total mass of the lubricating oil composition, (b) an amine-type antioxidant: 0.1–0.8 mass %, (c) a phosphate: 2–3 mass %, and (d) an amine salt of acid phosphate: 0.07–0.15 mass %.

As the base oil of the heat resisting lubricating oil composition (I), two kinds are proposed. The first base oil belongs to the above (i), and it consists of a mixture of (1) the above polyphenyl ether having 4 or 5 aromatic rings: 10–90 mass %; and (2) the above polyphenyl thioether having 3–5 aromatic rings:90–10 mass %.

A preferred polyphenyl ether has 5 aromatic rings (referred to as "pentaphenyl ether" for short as occasion demands in this specification). The mixing ratio of (1) polyphenyl ether to (2) polyphenyl thioether is preferably (2) 80–20 mass % to (1) 20–80 mass %, and more preferably, (2) 60–40 mass % to (1) 40–60 mass %.

When the mixing ratio of the polyphenyl thioether is less than 10 mass %, the wear resistance of the lubricating oil composition is deteriorated, and when it exceeds 90 mass %, the wear resistance is deteriorated, too, and a weak point is caused in the lubricating property.

A mixed polyphenyl ether-thioether obtained by substituting the oxygen atom of ether bond of the polyphenyl ether by sulfur atom, for example, 3-phenylmercapto-3'-phenoxydiphenyl ether and m-bis(m-phenylmercaptophenoxy)benzene can be also used.

The second base oil, which belongs to the above (ii), consists of a mixture of two or more polyphenyl thioethers having 3–5 aromatic rings represented by the general formula (I) and differed in number of the aromatic rings. A preferred polyphenyl thioether is a mixture of polyphenyl thioethers optionally selected from the group consisting of the above-mentioned polyphenyl thioethers so as to ensure the fluidity property. Concretely, for example, a mixed base oil consisting of m-bis(phenylmercapto)benzene (m-3P2T) and bis(m-phenylmercaptophenyl)sulfide (mm-4P3T) can be used.

The lubricating oil composition obtained by mixing the oil (a)(i) or (a)(ii) with the antioxidant and anti-wear agents (b)–(e) in specified ratios is resistant to heat and oxidation and also excellent in wear resistance, and a heat resisting lubricating oil composition having both the performances can be realized.

Lubricating Oil Composition (II)

A lubricating oil composition (II) according to this invention is obtained by mixing, to (a) a polyphenyl ether base oil having 5 aromatic rings, (b) a polyphenyl thioether: 0.05–5 mass %, (c) an amine-type antioxidant: 0.05–5 mass %, (d) a phosphate: 2–3 mass %, and (e) an amine salt of acid phosphate: 0.07–0.8 mass %.

According to this composition, the wear resistance can be improved without scarificing the heat and oxidation resistance of the polyphenyl ether base oil, and a lubricating oil composition passable of the requirement of USAF Standard MIL-PRF-87100A can be provided.

The lubricating oil composition (II) is completed on the basis of the following viewpoints. Namely, (1) The mixed base oil of polyphenyl ether and polyphenyl thioether is improved in wear resistance, but it is not sufficient to obtain a prescribed result.

(2) The use of a phosphorus-based anti-wear agent is necessary for the improvement in wear resistance, but the use of the phosphorus-type anti-wear agent deteriorates the heat and oxidation resistance.

(3) The improvement in heat and oxidation resistance by the phosphorus-type anti-wear agent can be attained by the mixing with an amine-type antioxidant.

From the above points (1)–(3), only the polyphenyl ether is used as the base oil, and the additives (b)–(e) of specified quantities are mixed thereto, whereby both heat and oxidation resistance and wear resistance can be enhanced.

In the heat resisting lubricating oil compositions (I) and (II) according to this invention, although the viscosity can be properly regulated according to a desired use, the dynamic viscosity at 100° C. is generally 2–15 cSt, preferably, 3–10 cSt. A high viscosity polyphenyl ether and a hydrocarbon non-substituted polyphenyl thioether, for example, m-bis(phenylmercapto)benzene, are used, whereby a lubricating oil composition controlled in physical properties can be provided.

To the heat resisting lubricating oil compositions according to this invention, a viscosity index improver, a pour point depressant, a corrosion inhibitor, a metal inactivator, and the like can be properly added as additives as occasion demands, in addition to the above anti-wear agent and antioxidant.

As the viscosity index improver, for example, those based on polymethacrylate, polyisobutylene, ethylene-propylene copolymer, and styrene-butadiene hydrogenated copolymer can be given. These can be generally used in a ratio of 1–35 mass %. As the corrosion inhibitor, those generally used in lubricating oils can be used.

Examples of the metal inactivator include benzotriazol, thiadiazol and the like, and these can be generally used in a ratio of 0.01–3 mass %. As the pour point depressant, for example, ethylene-vinyl acetate copolymer is used, and it can be generally used in a ratio of 0.01–5 mass %.

The thus-obtained heat resisting lubricating oil compositions are usable as jet engine oil, turbo charger engine oil, super-heat resisting adiabatic engine oil, gas turbine oil, continuously variable transmission oil, diffusion pump oil, rotary pump oil, oil retaining plastic oil, oil retaining bearing oil, radiation resisting lubricating oil and the like, which are used at high temperature.

EXAMPLES

This invention is further described in more detail in reference to Examples and Comparative Examples. This invention, however, is never limited by these examples.

For the performance evaluation of the lubricating oil compositions of this inventions, corrosive oxidation stability test method and four-ball test method were adapted. These test methods are illustrated below.

In the Examples and Comparative Examples, "%" means "mass %".

Corrosive Oxidation Stability Test (COS Test)

This method is determined in accordance with USAF MIL-L-23699 Standard. After 100 ml of a sample oil is subjected to an oxidation treatment by using Ag, Al, Fe and Ti as oxidation catalyst, and blowing air thereto in a ratio of 5 l/h at a temperature of 230° C. for 72 hrs, the metal piece weight change, viscosity change and total acid number change before and after the oxidation treatment and the sludge quantity formed after the oxidation treatment are measured.

For the metal piece weight change of the above items, pass is judged when the weight change/surface product of a metal piece before and after oxidation treatment is ±0.2 $mg/cm^2$ or less. The viscosity change is the dynamic viscosity change (%) at 40, the total acid number change is the difference in total acid value (mgKOH/g), and the sludge quantity is the weight (mg/100 ml) to 100 ml of the residual sample oil after the oxidized sample oil is filtered by use of a filter with a pore diameter of 10 $\mu$m manufactured by Millipore.

Four-Ball Test

In the wear test by use of a Shell 4-ball tester, the following test conditions are adapted on the basis of ASTM D2596-82, test balls of three materials described below were used as rotating ball and fixed ball as shown in each example. The average wear scar (mm) of three fixed balls after 30-min operation was determined.

Test Conditions: Temperature (°C.): 80
Load (kg): 294N
Rotating Speed (rpm): 1,200
Test Balls: SUJ-2 (high carbon chromium steel)

Example 1

A mixture (OS-124 manufactured by Monsanto, hereinafter referred to as "5P4E isomeric mixture") 43.83% of m-bis(m-phenoxyphenoxy)benzene (mmm-5P4E) 65%, 1-(m-phenoxyphenoxy)-3-(p-phenoxyphenoxy)benzene (mmp-5P4E) 30% and p-bis(m-phenoxyphenoxy)benzene (mpm-5P4E) 5%; m-bis(phenylmercapto)benzene (hereinafter referred to as "m-3P2T") 53.57%; alkylnaphthylamine (R-PAN) 0.5%; tricresyl phosphate 2%; and amine salt of acid phosphate (dodecylaniline salt of acidic isopropyl phosphate (vanlube 692) 0.1% were mixed together to prepare a lubricating oil composition. The resulting lubricating oil composition was subjected to the above-mentioned corrosive oxidation stability test (COS test) and 4-ball test to measure the heat and oxidation resistance stability and wear resistance. As shown in Table, satisfactory evaluation results could be obtained for both the performances.

Example 2

The 5P4E isomeric mixture 43.38%, m-3P2T 53.02%, alkylnaphtylamine (R-PAN) 0.5%, tricresyl phosphate 3% and amine salt of acid phosphate 0.1% were mixed together to prepare a lubricating oil composition. The evaluation result is shown in Table 1.

Example 3 m-Phenoxyphenoxy m-biphenyl (mm-4P2E) 64.30%, m-3P2T 33.10%, alkylnaphthylamine (R-PAN) 0.5%, tricresyl phosphate 2% and amine salt of acid phosphate 0.1% were mixed to prepare a lubricating oil composition. The evaluation result for the heat and oxidation resistance and wear resistance thereof are shown in Table 1.

Example 4

To a mixture of m-3P2T 48.70% and bis(m-phenylmercaptophenyl)sulfide (hereinafter referred to as "mm-4P3T") 48.70% were mixed alkylnaphthylamine (R-PAN) 0.5%, tricresyl phosphate 2% and amine salt of acid phosphate 0.1% in the same quantities as in Example 1 to prepare a lubricating oil composition. The evaluation result for the heat and oxidation resistance and wear resistance thereof are shown in Table 1.

Comparative Example 1

The 5P4E isomer mixture 45.00% was mixed with m-3P2T 55.00% to prepare a lubricating oil composition. The evaluation result is shown in Table 1. Although a satisfactory result could be obtained for the heat and oxidation resistance, the wear resistance was poor with a wear scar of 0.9 mm in SUJ2/SUJ2.

Comparative Examples 2–9

Each component shown in Table 1 (Comparative Examples 2–3) and Table 2 (Comparative Examples 4–9) was mixed in the ratio shown in the same tables to prepare lubricating oil compositions. The evaluation results are shown in the same tables. When any one of the essential components is absent, the resulting lubricating oil composition is inferior in both or either one of the heat and oxidation resistance and the wear resistance.

Example 5

A lubricating oil composition consisting of 5P4E isomeric mixture 95.7%, m-3P2T 2%, alkylnaphthylamine 0.1%, diphenylamine 0.1%, tricresyl phosphate 2%, and amine salt of acid phosphate 0.1% was prepared. The evaluation result is shown in Table 3 .The heat and oxidation resistance is remarkably improved even under a further sever condition (COS test condition of 260×72 h severer than the COS test condition of 230° C.×72 h), compared with the condition of Example 1, and the wear resistance can be improved while keeping the excellent heat and oxidation resistance of the 5P4E isomeric mixture.

Example 6

A lubricating oil composition consisting of 5P4E isomer mixture 94.7%, mm-4P3T 2%, alkylnaphthylamine 0.1%, diphenylamine 0.1%, tricresyl phosphate 3% and amine salt of acid phosphate 0.1% was prepared. The evaluation result is shown in Table 3. When the tricresyl phosphate was increased, compared with the lubricating oil composition of Example 5, the heat and oxidation resistance was deteriorated although the wear resistance was slightly improved. From this fact, it is found that an optimum value is present in the mixing ratio of the tricresyl phosphate.

Comparative Example 10

Only the 5P4E isomeric was used to prepare a lubricating oil composition. The evaluation result is shown in Table 3. It is found from the table that the heat and oxidation resistance is extremely excellent, but the wear resistance is inferior.

Comparative Examples 11–16

As shown in Table 3, lubricating oil compositions in which either one of the necessary components of the lubricating oil composition according to this invention was absent were prepared. The constitution and effect of each lubricating oil composition are shown in Table 3.

Comparative Example 17 m-Phenoxyphenoxy m-biphenyl (mm-4P2E) 95.7%, alkylnaphthylamine 0.1%, diphenylamine 0.1%, mm-3P2T 2%, tricresyl phosphate 2% and amine salt of acid phosphate 0.1% were mixed together. The evaluation result is shown in Table 3. It is found from the table that the heat and oxidation resistance is in no way inferior, but the wear resistance is extremely inferior.

Comparative Example 18

A commercially available aircraft turbine oil is shown in Table 2. It is found from the table that the wear resistance is in a considerable level, but the heat and oxidation resistance is remarkably inferior.

TABLE 1

Polyphenyl Ether-Polyphenyl Thioether-Based/Polyphenyl Thioether Mixture-Based Lubricating Oil Composition

| | | Ex. 1 | Ex. 2 | Ex. 3 | Ex. 4 | C.Ex.1 | C.Ex.2 | C.Ex.3 |
|---|---|---|---|---|---|---|---|---|
| Base Oil | 5P4E(OS-124)[1)] | 43.83 | 43.38 | — | — | 45.00 | 44.33 | 43.88 |
| (mass %) | 3P2T[2)] | 53.57 | 53.02 | 33.10 | 48.70 | 55.00 | 54.17 | 53.62 |
| | 4P3T[3)] | — | — | — | 48.70 | — | — | — |
| | 4P2E[4)] | — | — | 64.30 | — | — | — | — |
| Antioxidant | Alkylnaphthylamine (R-PAN)[5)] | 0.5 | 0.5 | 0.5 | 0.5 | — | 0.5 | 0.5 |
| (mass %) | TCP | 2 | 3 | 2 | 2 | — | 1 | 2 |
| Additive (mass %) | Amine Salt of Acid Phosphate[6)] | 0.1 | 0.1 | 0.1 | 0.1 | — | — | — |
| Viscosity (cSt) | 40° C. | 34.4 | 34.2 | 43.8 | 34.2 | 34.7 | 34.3 | 34.2 |
| | 100° C. | 5.1 | 5.0 | 5.1 | 5.0 | 5.1 | 5.1 | 5.1 |
| Pour Point (° C.) | | −30.0 | −30.0 | −30.0 | −30.0 | −30.0 | −30.0 | −30.0 |
| COS Test | Viscosity Change % (40° C.) | 19.0 | 24.6 | 17.8 | 19.6 | 1.1 | 5.3 | 8.9 |
| (230° C. × 72 h) | Total Acid Number Change (mgKOH/g) | 0.3 | 0.5 | 0.3 | 0.3 | 0.0 | 0.2 | 0.3 |
| | Metal Weight Change | Pass | Pass | Pass | Pass | Pass | Pass | Pass |
| | Sludge (mg/100 ml) | 9.1 | 10.3 | 7.9 | 8.3 | 3.5 | 4.2 | 4.9 |
| 4-Ball Test Wear Scar* (mm) | SUJ-2/SUJ-2 | 0.58 | 0.58 | 0.60 | 0.54 | 0.90 | 0.83 | 0.77 |

*Test Condition: 80° C. × 294 N × 1200 rpm × 30 min

TABLE 2

Polyphenyl Ether-Polyphenyl Thioether-Based/Polyphenyl Thioether Mixture-Based Lubricating Oil Composition

| | | C.Ex.4 | C.Ex.5 | C.Ex.6 | C.Ex.7 | C.Ex.8 | C.Ex.9 | C.Ex.18 |
|---|---|---|---|---|---|---|---|---|
| Base Oil | 5P4E(OS-124)[1)] | 43.43 | 42.53 | 44.73 | 44.69 | — | — | Commercially |
| (mass %) | 3P2T[2)] | 53.07 | 51.97 | 54.67 | 54.61 | 50.00 | 34.00 | available gas turbine oil |
| | 4P3T[3)] | — | — | — | — | 50.00 | — | |
| | 4P2E[4)] | — | — | — | — | — | 66.00 | |
| Antioxidant | Alkylnaphthylamine (R-PAN)[5)] | 0.5 | 0.5 | 0.5 | 0.5 | — | — | |
| (mass %) | TCP | 3 | 5 | — | — | — | — | |
| Additive (mass %) | Amine Salt of Acid Phosphate[6)] | — | — | 0.1 | 0.2 | — | — | |
| Viscosity (cSt) | 40° C. | 34.1 | 33.7 | 34.8 | 34.9 | 22.5 | 44.2 | 26.7 |
| | 100° C. | 5.1 | 5.1 | 5.1 | 5.1 | 4.1 | 5.1 | 5.2 |
| Pour Point (° C.) | | −30.0 | −30.0 | −30.0 | −30.0 | −30.0 | −30.0 | <−50 |
| COS Test | Viscosity Change % (40° C.) | 13.8 | 25.1 | 9.8 | 21.1 | 1.3 | 2.6 | 98.9 |
| (230° C. × 72 h) | Total Acid Number Change (mgKOH/g) | 0.4 | 1.1 | 0.0 | 0.1 | 0.0 | 0.0 | 17.1 |
| | Metal Weight Change | Pass | Rejected | Pass | Pass | Pass | Pass | Pass |
| | Sludge (mg/100 ml) | 5.8 | 40.7 | 4.0 | 38.2 | 3.2 | 2.0 | 45.8 |
| 4-Ball Test Wear Scar* (mm) | SUJ-2/SUJ-2 | 0.70 | 0.58 | 0.68 | 0.67 | 0.88 | 1.42 | 0.69 |

*Test Condition: 80° C. × 294 N × 1200 rpm × 30 min

TABLE 3

Pentaphenyl Ether (5P4E)-Based Lubricating Oil Composition

| | | Ex. 5 | Ex. 6 | C.Ex. 10 | C.Ex. 11 | C.Ex. 12 | C.Ex. 13 | C.Ex. 14 | C.Ex. 15 | C.Ex. 16 | C.Ex. 17 |
|---|---|---|---|---|---|---|---|---|---|---|---|
| Base Oil (mass %) | 5P4E(OS-124)[1] | 95.7 | 94.7 | 100 | 97.8 | 95.8 | 96.8 | 94.8 | 99.7 | 99.6 | — |
| | 4P2E[4] | — | — | — | — | — | — | — | — | — | 95.7 |
| | Alkylnaphthylamine (R-PAN)[5] | 0.1 | 0.1 | — | 0.1 | 0.1 | 0.1 | 0.1 | 0.1 | 0.1 | 0.1 |
| Antioxidant (mass %) | Diphenylamine[7] | 0.1 | 0.1 | — | 0.1 | 0.1 | 0.1 | 0.1 | 0.1 | 0.1 | 0.1 |
| | 3P2T[2] | 2 | — | — | — | 2 | — | — | — | — | 2 |
| | 4P3T[3] | — | 2 | — | — | — | — | — | — | — | — |
| Additive (mass %) | TCP | 2 | 3 | — | 2 | 2 | 3 | 5 | — | — | 2 |
| | Amine Salt of Acid Phosphate[6] | 0.1 | 0.1 | — | — | — | — | — | 0.1 | 0.2 | 0.1 |
| Viscosity (cSt) | 40° C. | 229.5 | 234.5 | 292.0 | 259.8 | 238.0 | 250.6 | 234.0 | 281.5 | 280.3 | 105.8 |
| | 100° C. | 11.7 | 11.6 | 12.7 | 12.1 | 11.8 | 11.9 | 11.6 | 12.6 | 12.5 | 7 |
| | Viscosity Change % (40° C.) | 5.0 | 6.0 | 1.7 | 9.2 | 4.1 | 14.2 | 27.3 | 9.7 | 20.8 | 5.1 |
| COS Test (230° C. × 72 hr) | Total Acid Number Change (mgKOH/g) | 0.03 | 0.1 | 0.02 | 0.4 | 0.03 | 0.5 | 1.3 | 0.05 | 0.1 | 0.03 |
| | Metal Wt. Change | Pass | Pass | Pass | Pass | Pass | Pass | Re-jected | Pass | Rejected | Pass |
| | Sludge (mg/100 ml) | 2.0 | 2.2 | 2.7 | 4.8 | 1.8 | 7.2 | 41.6 | 4.0 | 35.1 | 2.1 |
| | Viscosity Change % (40° C.) | 15.2 | 16.6 | 12.1 | 20.6 | 13.6 | 29.8 | 54.7 | 23.7 | 42.3 | 15.4 |
| COS Test (260° C. × 72 hr) | Total Acid Number Change (mgKOH/g) | 0.3 | 0.5 | 0.3 | 3.9 | 0.3 | 4.6 | 6.2 | 0.5 | 1.2 | 0.3 |
| | Metal Wt. Change | Pass | Pass | Pass | Pass | Pass | Pass | Re-jected | Pass | Rejected | Pass |
| | Sludge (mg/100 ml) | 5.0 | 5.3 | 6.2 | 10.2 | 4.2 | 13.8 | 83.4 | 8.3 | 81.3 | 5.4 |
| 4-Ball Test Wear Scar (mm)* | SUJ-2/SUJ-2 | 0.68 | 0.65 | 1.42 | 1.17 | 1.17 | 1.02 | 0.82 | 0.99 | 0.85 | 2.43 |

(Note)

As each mixing agents in Examples and Comparative Examples, the followings were used.

(1) 5P4E Isomeric mixture: OS-124 manufactured by Monsanto (2) 3P2T: Synthetic product m-3P2T manufactured by our own company (3) 4P3T: Synthetic product mm-4P3T manufactured by our own company (4) m-Phenoxyphenoxy m-biphenyl (mm-4P2E): S-3103 manufactured by Matsumura Petroleum Research Center (5) Alkylnaphthylamine R-PAN: IRGANOX L06

(6) Diphenylamine salt: Vanlube 81

(7) Amine salt of acid phosphate: Vanlube 692

It was clarified from the above Examples and Comparative Examples that the heat and oxidation resistance deteriorated by the phosphorus-type anti-wear agent added for the improvement in wear resistance of the polyphenyl ether or polyphenyl thioether excellent in heat and oxidation resistance can be improved by the mixing of specified components, and a lubricating oil composition excellent in both heat and oxidation resistance and wear resistance can be provided.

As described above, according to this invention, a polyphenyl ether having 4–5 aromatic rings and/or polyphenyl thioether is used as base oil, and specified quantities of an amine-type antioxidant, a phosphate, and an amine salt of acid phosphate are mixed thereto as essential components, whereby the heat and oxidation resistance deteriorated by the mixing of phosphate-based and acidic phosphate-based wear resisting agents can be restrained by the mixing of the amine-type antioxidant to improve the wear resistance while retaining the heat and oxidation resistance of the polyphenyl ether and polyphenyl thioether, and a heat resisting lubricating oil composition capable of satisfying the requirement of MIL-PRF-87100 (USAF) can be thus provided.

What is claimed is:

1. A lubricating oil composition comprising:

(a) a base oil consisting of a composition selected from:

(i) a mixture of a polyphenyl ether having 4–5 aromatic rings and/or its hydrocarbon substituted group with a polyphenyl thioether having 3–5 aromatic rings represented by the following general formula [I] or (ii) a polyphenyl thioether having 3–5 aromatic rings represented by the following general formula [I]

[I]

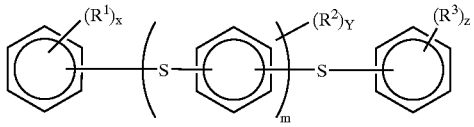

wherein $R^1$, $R^2$ and $R^3$, which may be the same or different, each represents hydrogen atom or a hydrocarbon group having 1–24 carbon atoms, x, y and z, which may be the same or different, each represents an integer of 1–4, and m represents an integer of 1–3;

(b) an amine antioxidant: 0.1–0.8 mass %, on the basis of the total mass of the lubricating oil composition;

(c) a phosphate: 2–3 mass %; and (d) an amine salt of acid phosphate: 0.07–0.15 mass %.

2. A lubricating oil composition comprising:

(a) a base oil consisting of a polyphenyl ether having 5 aromatic rings and/or its hydrocarbon substituted group;

(b) A polyphenyl thioether represented by the general formula [I]: 0.05–5 mass %, on the basis of the total mass of the lubricating oil

[I]

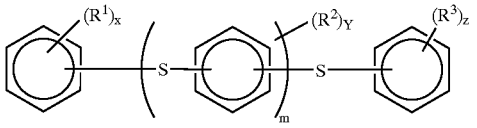

wherein $R^1$, $R^2$ and $R^3$, which may be the same or different, each represents hydrogen atom or a hydrocarbon group having 1–24 carbon atoms, x, y, and z, which may be the same or different, each represents an integer of 1–4, and m is an integer of 1–3;

(c) an amine antioxidant: 0.05–5 mass %

(d) a phosphate: 2–3 mass %; and (e) an amine salt of acid phosphate: 0.07–0.3 mass %.

3. A lubricating oil composition according to claim 1 or 2 wherein the polyphenyl thioether is a compound represented by the general formula [II]:

[II]

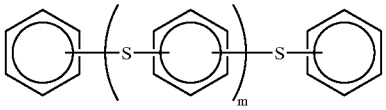

wherein m is an integer of 1–3.

4. A lubricating oil composition according to claim 1 wherein the polyphenyl thioether is a mixture of at least two compounds having a different number of aromatic rings to each other.

5. A lubricating oil composition according to claim 1 or 2 wherein the amine salt of acid phosphate is an aromatic amine salt of acidic phosphate.

6. A lubricating oil composition according to claim 3 wherein the polyphenyl thioether is a mixture of at least two compounds having a different number of aromatic rings to each other.

* * * * *